US010710777B2

(12) United States Patent
Costa

(10) Patent No.: US 10,710,777 B2
(45) Date of Patent: Jul. 14, 2020

(54) AUTOMATIC OPENING DEVICE FOR CARTON PACKAGES

(71) Applicant: Ivan Ferreira da Costa, São Paulo (BR)

(72) Inventor: Ivan Ferreira da Costa, São Paulo (BR)

(73) Assignee: Icmatech Inovações Tecnológicas, Rio de Janeiro (BR)

( * ) Notice: Subject to any disclaimer, the term of this patent is extended or adjusted under 35 U.S.C. 154(b) by 31 days.

(21) Appl. No.: 15/529,372

(22) PCT Filed: Nov. 24, 2014

(86) PCT No.: PCT/BR2014/000415
§ 371 (c)(1),
(2) Date: May 24, 2017

(87) PCT Pub. No.: WO2016/082008
PCT Pub. Date: Jun. 2, 2016

(65) Prior Publication Data

US 2018/0319550 A1 Nov. 8, 2018

(51) Int. Cl.
*B65D 41/04* (2006.01)
*B65D 5/74* (2006.01)

(52) U.S. Cl.
CPC ..... *B65D 41/0471* (2013.01); *B65D 5/748* (2013.01)

(58) Field of Classification Search
CPC ..... B65D 41/0471; B65D 5/748
USPC ..... 215/222, 257, 332, 329; 220/258.3–258.5, 277, 278
See application file for complete search history.

(56) References Cited

U.S. PATENT DOCUMENTS 3,339,812 A * 9/1967 Meissner ..... B65D 51/222 222/566
3,927,783 A * 12/1975 Bogert ..... B65D 41/06 215/222
4,482,073 A * 11/1984 Gagliardi ..... B65D 41/045 215/332

(Continued)

FOREIGN PATENT DOCUMENTS

BR PI0702838 A * 4/2008 ..... B65D 5/748
BR 0311973 B1 * 11/2012 ..... B65D 5/748

(Continued)

*Primary Examiner* — James N Smalley
(74) *Attorney, Agent, or Firm* — Nevrivy Patent Law Group P.L.L.C.

(57) ABSTRACT

An automatic opening device for a carton package comprising a spout (3) and a cap (26), the device being provided with a plurality of protruding cutting elements (30) onto the internal face (29) of a cap element (27) thereof. The spout (3) is provided with a thread (2) having grooves (2*c*) and (2*f*) of opposite orientation and connected each other, within which pass internal screw thread segments (19) distributed equidistantly in the internal part of the elongate lateral wall (28) of the cap (26). The spout is applied in a carton package over a hole in the carton layer which exposes the aluminium layer. When the cap (26) is unscrewed from the spout (3) the first time it makes a downward axial movement and next the protruding cutting elements (30) are able to cut the aluminium layer of the carton package in order to open a passage for the content of the carton package.

12 Claims, 3 Drawing Sheets

(56) References Cited

U.S. PATENT DOCUMENTS

| | | | | |
|---|---|---|---|---|
| 6,202,876 | B1 * | 3/2001 | DeJonge | B65D 41/06 215/208 |
| 6,854,617 | B2 * | 2/2005 | Taylor | B44D 3/12 215/202 |
| 2001/0047976 | A1 * | 12/2001 | Frank | B65D 25/44 215/208 |
| 2004/0007556 | A1 * | 1/2004 | Manera | B65D 41/06 215/332 |
| 2007/0039914 | A1 * | 2/2007 | Buono | B65D 50/046 215/222 |

FOREIGN PATENT DOCUMENTS

| | | | | |
|---|---|---|---|---|
| BR | MU9100630 | U2 * | 5/2013 | B65D 5/748 |
| WO | WO-03035491 | A1 * | 5/2003 | B65D 5/748 |

* cited by examiner

AUTOMATIC OPENING DEVICE FOR CARTON PACKAGES

The present invention relates to an automatic opening device for carton packages which comprises a spout provided with an outer thread comprising a first groove followed by a second groove of opposite orientation and a cap screwed thereto, wherein the cap is provided with means able to tear the material of the package when the cap is unscrewed the first time.

A screw thread is a helical structure that basically comprises a groove and an elevation or ridge applied to the surface of a cylindrical or slightly conical body to form a helical surface.

Screw threads can be applied to the external surface of a cylindrical or slightly tapered body, in this case known by the terms "outer thread" or "male threads", or may be applied on the inner surface of a cylindrical or conical cavity, in this case known by the expressions "inner thread" or "female threads".

The cross section of a thread can have various shapes, e.g., square, triangular, trapezoidal, and others.

Screw systems are those wherein an element provided with an inner thread engages an element provided with an outer thread, through the action of a rotational movement that causes the engagement of the ridge of the threads into the grooves of the other.

When this engagement occurs, and with the continuity of the rotational movement, the helical surface of the thread causes, in addition to a rotational movement occurring between these two elements, a longitudinal movement which also occurs between them.

In other words, screw threads can convert rotational force or movement to linear, or vice versa.

A typical example of a threaded system is an internal screw thread lid which engages the neck of a bottle, which is provided with an outer thread.

The rotational movement of driving a cap to engage it to a bottleneck is called a screwing. The rotational movement of disengaging the cap relative to a neck is called unscrewing.

The invention of the screw thread is attributed to the Greek mathematician Architas of Tarentum, which occurred in the fifth century before Christ. It is classified as one of the fundamental machines created in the beginnings of mankind, which is present in most of the apparatuses used today.

Screw threads have several uses, and may, for example, be used for:

- Fixing objects to each other (for example, bolts and nuts), in this case called retaining threads;
- Transmitting movements (e.g., jacks and automotive gear boxes), in this case called transmission threads;
- Serving as sealing elements (e.g., for pipes and caps of various packages).

As for the direction of the rotational movement for screwing, screw threads can be classified into two basic types:

- Right-hand threads, wherein the screwing movement occurs in the clockwise direction;
- Left-hand threads, wherein the screwing movement occurs in the counterclockwise direction.

As for the typification, threads may be classified into two basic types:

- Single-ridged thread, or single thread, provided with only one entry;
- Multiple-ridged thread, or thread of multiple entries, provided with at least two entries.

The pitch of a thread is defined as the linear distance between the crest of two adjacent ridges of the screw thread, measured relative to a line parallel to the thread axis of symmetry. A determining factor for the definition of the linear distance is the thread angle of inclination in relation to its generatrix.

The lead or retreating movement of a threaded element, a bolt for example, is defined as the longitudinal movement effected by this threaded element after performing a complete rotation through 360°.

The magnitude of this lead or retreating movement of a threaded element is determined by the pitch of this thread.

In case the threaded element is provided with a single thread, of single start, the pitch and the magnitude of the longitudinal movement of lead or retreat have the same measure. If the threaded element is provided with multiple thread starts, in this case the magnitude of the longitudinal movement of advance or retreat is equivalent to the measure of the pitch multiplied by the number of thread starts.

Thus, the movement of advance or retreat can be defined by the formula below:

$$L=N\times P$$

Wherein:

L→lead or retreat

N→number of thread starts

P→thread pitch

Whatever application is given to a thread, the magnitude of the movements of lead and retreat will always be determined by the thread pitch. This is an immutable physical relationship.

The immutability characteristic of the relationship between the longitudinal movement (advance or retreat) and the pitch of a screw thread hinders, or even prevents them, from being applied in situations where it would be necessary for the magnitude of these longitudinal movements to be variable for a screwing or unscrewing process of two threaded members.

When such a need occurs, designers are forced to seek solutions, and these solutions usually have a certain complexity in addition to causing undesirable manufacturing cost increases.

Among others, a segment in which this problem is clearly observed is in packages used for the storage of liquids, especially disposable packages, wherein such packages are manufactured with spouts provided with devices to open the package.

Disposable packages are now widely used in the packaging of different types of liquids, especially in the dairy and fruit juice industry, or the like.

One type of well-known package is made of a fibrous, thin laminate material, usually paper, to which is attached a second thin laminated material of high strength, usually aluminium. A layer of impermeable thermoplastic material, usually polyethylene, is applied to this layered composite.

This type of material has a very low manufacturing cost, and may easily be configured to take several forms. This greatly facilitates the manufacturing process of a package with this kind of material. These packages are referred to as carton packages.

It is desirable that packages made from this material are provided with a device to open the package which enables its content to flow through this spout, when it is necessary to use it. It is also desirable that the device to open the package is provided with a cap, usually a threaded lid, which can be used as a sealing element in situations where only a part of the package's content was removed and the remaining content must remain sealed within the package.

For reasons of hygiene and food security, the devices to open the spout of these packages must necessarily be designed so that the package is hermetically and aseptically sealed in the industrialization process, and shall remain so until the moment it is necessary to remove its content.

In the case of packages manufactured with the above-mentioned laminate material, it is common that the product be hermetically packaged inside the package and the device to open the spout is designed so that by rotating the threaded cap, it is unscrewed from the spout. This unscrewing movement provokes a movement in the internal components of the device to open the spout, which causes the opening of a passageway in the portion of the laminated material upon which the device to open the spout is affixed.

This action then opens an aperture located immediately below the device to open the spout, enabling the content of the package to be removed from the interior thereof through said device to open the spout. In case the entire content of the package is not removed, it will suffice to engage the screw cap back onto the threaded spout of the device to open the spout so that the package is closed again.

This type of device to open the spout is known by the expression "automatic opening device".

The Brazilian patent PI0213426-8, corresponding to international patent application WO03/035491 and incorporated herein by reference, discloses an automatic opening device which can be used in packages manufactured in a similar laminated material as the material described above.

This automatic opening device comprises a spout element 4 and a lid 2. The spout element 4 includes a flat base 29 integral with a spout 24, the latter being provided with an outer screw thread 42 and the liquid into the package being poured through the spout.

A tab 26 is connected to the lower end of the spout element 4 by means of a pivoting element 28. An annular space 30 is provided between the flange of the tab 26 and the inner wall of the spout 24 so that the tab 26 can tilt within the spout 24 together with the pivoting element 28.

A cam follower 32 is integral to the upper surface of the tab 26, and a cutting element 34 is integral to the lower surface of the tab 26.

The cap element 2 comprises a lid 5 integral with a cylindrical side wall 34, which is provided with an inner thread 6. The inner bottom surface of the lid 5 is provided with a first cam 8, which can engage the cam follower 32 of the tab 26. A second cam 9 is provided on the inner bottom surface of the lid 5 in an outer region in relation to the region where the first cam 8 is situated.

When the cap 2 of the device to open the spout is unscrewed for the first time, this rotational movement causes the first cam 8 to engage the cam follower 32. As the rotational movement of the cap 2 progresses, the first cam 8 exerts a force on the cam follower 32, and consequently on the tab 26.

As the tab 26 is connected to the pivoting element 28, consequently the tab 26 will pivot towards the inside of the package. As a result, the cutting element 34 will be forced against the portion of the laminate material of the package which is located immediately below, thereby promoting a cut in this region. This will open a passage for the liquid packed inside the package to flow through the spout element 4.

In certain circumstances the cam follower 32 may be positioned in a manner that does not contact the cam 8, whereby the automatic opening device will not operate in due manner. In this case, when the cap element 2 is screwed in the threaded spout 4, at a certain instant the cam follower 32 will contact the surface 14 of the second cam 10.

With the continued screwing movement, the cam follower 32 will be directed by the second cam 10 to position at the initial portion 12 of the first cam 8. Thus, the cam follower 32 will then be correctly positioned for future opening operations of the automatic opening device.

A disadvantage observed in the automatic opening device described in patent document PI0213426-8 is that the actuation of the mechanism occurs in the unscrewing movement of the cap 2 of the spout 4. As this rotational movement causes the cam 8 to move away from the cap 2 relative to the cam follower 32 of the tab 26, it consequently becomes necessary to provide these two parts with a vertical elongation to obtain the desired mechanical effect of piercing and tearing the laminated material of the package by the cutting member 34, as described above.

This vertical elongation of these two parts, and consequently the cap 2 and the spout 4 generates a device with relatively large dimensions. This makes it difficult to stack the packages in transport packages which causes problems in transporting the same.

Further, this causes an undesirable increase in raw material consumption, and consequently an increase in the injection time of the parts, thereby increasing manufacturing costs.

In the Brazilian patent PI0311973-4 it is described a solution for the problem caused by movement away from the cover relative to the cutting element of the package, by means of a third independent piece which makes an opening in the package.

Although this solution provides a smaller cap and spout assembly, which facilitates the storage and transport of the packages, it has the disadvantage of requiring the manufacture of a third part which causes a greater consumption of raw material, as well as the need for the use of three injection moulding tools, one for each part, and, consequently, longer manufacturing times.

Moreover, there is also a need for three pieces to be assembled at the time of manufacture instead of two, which makes the assembly more complex. This assembly is automated without human manual contact, with the aim to prevent contamination.

In the Brazilian patents PI0518924-1, PI0702838-5, PI0702839-3 and PI0702842-3 there are descriptions of devices basically comprising a spout and a cover in which a third part is assembled into the spout and is used to make an opening in the package. These have the same drawbacks mentioned above in relation to the Brazilian patent document PI0311973-4.

A common problem observed in all the above-mentioned patent documents is that, when the caps are unscrewed for the first time, the driving mechanisms at the cap must drive the cutting element to make it cut an opening in the package, thereby allowing the content of the package to then be removed from its interior.

This move away movement is unavoidable, as the movements of advance and move away from a threaded element are solely dependent on the pitch of the thread and the number of entries thereof, which is a fixed and unchanging relationship, as it was mentioned above When these caps are unscrewed the first time the driving mechanisms in the inner bottom surface of the cap must activate the said package opening mechanism. However, as the driving mechanisms tend to move away from the package opening mechanism, it is then necessary that the driving mechanism is designed to compensate for such moving away movement.

The solution used was to elongate the drive mechanisms toward the inside of the spout to offset the said moving away movement, as verified in the object of PI0213426-8. As previously mentioned, this elongation causes many problems, such as an increase in the dimensions of the cap and the spout, greater material consumption and increased manufacturing time, as well as it causes an increase in the dimensions of the device, thereby causing difficulties for the stacking of packages.

The present invention relates to an automatic opening device for carton packages which enables such drive mechanisms to be designed without the need to provide an elongation of components to offset the ascending longitudinal movement when unscrewing a cap from a spout the first time, whereby obviating the need of a third part to make the package open.

These and other objects of the present invention will become more readily apparent through the detailed description of the invention that follows hereinafter, with reference to the accompanying drawings.

BRIEF DESCRIPTION OF THE DRAWINGS

The features of the present invention will be better appreciated from the detailed description which follow, by way of example, associated with the attached drawings referenced below which are an integral part of this specification.

DESCRIPTION OF EMBODIMENTS OF THE INVENTION

FIGS. 1 to 6 depict a device provided with a spout and a cap in which is employed a mechanism to open a carton package which uses the automatic opening device object of the present invention, with the purpose of obtaining longitudinal movements of advance and retreat to cause the opening of the package.

Figure 1:
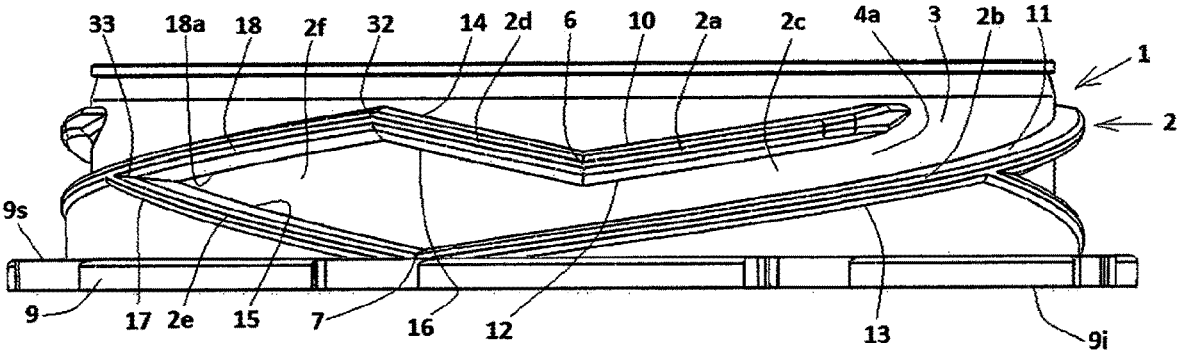
FIG. 1 is a front view of a spout provided with an outer thread which is part of the automatic opening device for carton packages object of the present invention.

In FIG. 1, according to the present embodiment it can be observed an automatic opening device 1 object of the present invention applied to an elongate cylindrical body 3. An outer screw thread 2 is provided in the outer surface of an elongated cylindrical body 3, which in the present case is a three-entries thread.

The elongated cylindrical body 3 may, for example, be a spout of a package to which a cap 26, not shown in the Figure, may be screwed onto the upper face 9*s* of a base element 9, whose lower face 9*i* shall be affixed to a package, as shown in FIGS. 1 to 6.

Hereafter, the expression "spout" and the expression "elongate cylindrical body" will be used interchangeably, i.e., to indicate the same component.

Each ridge of the outer thread 2 comprises a first downward upper thread 2*a*, provided with an upper flank 10 and a lower flank 12, and a first downward lower thread 2*b*, provided with an upper flank 11 and a lower flank 13.

A downward groove 2*c* is formed between the first downward upper thread 2*a* and the first downward lower thread 2*b*, and is provided with an inlet 4*a*.

The outer thread 2 also comprises a second downward upper thread 2*d*, adjacent to the first downward upper thread 2*a*, a second upward lower thread 2*e*, adjacent to the first downward lower thread 2*b*, and an end-stop 18.

The second upward upper thread 2*d* is provided with an upper flank 14 and a lower flank 16, and the second upward lower thread 2*e* is provided with an upper flank 15 and a lower flank 17. The end-stop 18 is provided with a lower flank 18*a*.

An upward groove 2*f* is formed between the second upward upper thread 2*d*, the second upward lower thread 2*e* and the end-stop 18.

At a first junction point 6, there is a connection between each first downward-upper thread 2*a* and each second upward upper thread 2*d*, so that the transition from the lower flank 12 of the first downward upper thread 2*a* to the lower flank 16 of the second upward upper thread 2*d* is such that one flank is a continuity of the other and forms a concave angle there between.

At the first junction point 6 a transition occurs from the right-handed thread configuration of the first downward upper thread 2*a* to a left-handed thread configuration of the second upward upper thread 2*d*.

Thus, the angle of inclination of the first downward upper thread 2*a* relative to the thread generatrix and the inclination angle of the second upward upper thread 2*d* relative to the thread generatrix are chosen to form a right-handed thread and a left-handed-thread, respectively.

At a second junction point 7 a union occurs between each first downward lower thread 2*b* and each second upward lower thread 2*e*, so that the transition from the upper flank 11 of the first downward lower thread 2*b* to the upper flank 15 of the second upward lower thread 2*e* is such that one flank is as an extension of the other and forms a convex angle between them.

At the second junction point 7 a transition occurs from a right-handed thread configuration of the first downward lower thread 2*b* to a left-handed thread configuration for the second upward lower thread 2*e*.

Thus, the inclination angle of the first downward lower thread 2*b* in relation to the thread generatrix and the inclination angle of the second upward lower thread 2*e* in relation to the thread generatrix are both chosen to form to a right-handed thread and a left-handed thread, respectively.

The angle of inclination of the left-handed thread from the second upward lower thread 2*e* is substantially equal to the angle of inclination of the left-handed thread of the second upward upper thread 2*d*.

The second upward upper thread 2*d* is attached to the end-stop 18 at a third junction point 32. The end-stop 18 has a right-handed thread configuration, having an angle of inclination substantially identical to the angle of the first downward upper thread 2*a* and the first downward lower thread 2*b*.

As the second upward lower thread 2*e* is a left-handed thread, consequently the end-stop 18 will join the second upward lower thread 2*e* at a fourth junction point 33. The upward groove 2*f* is formed between the second upper thread 2*d*, the second lower thread 2*e* and the end-stop 18, as can be seen in FIG. 1.

Figure 2:
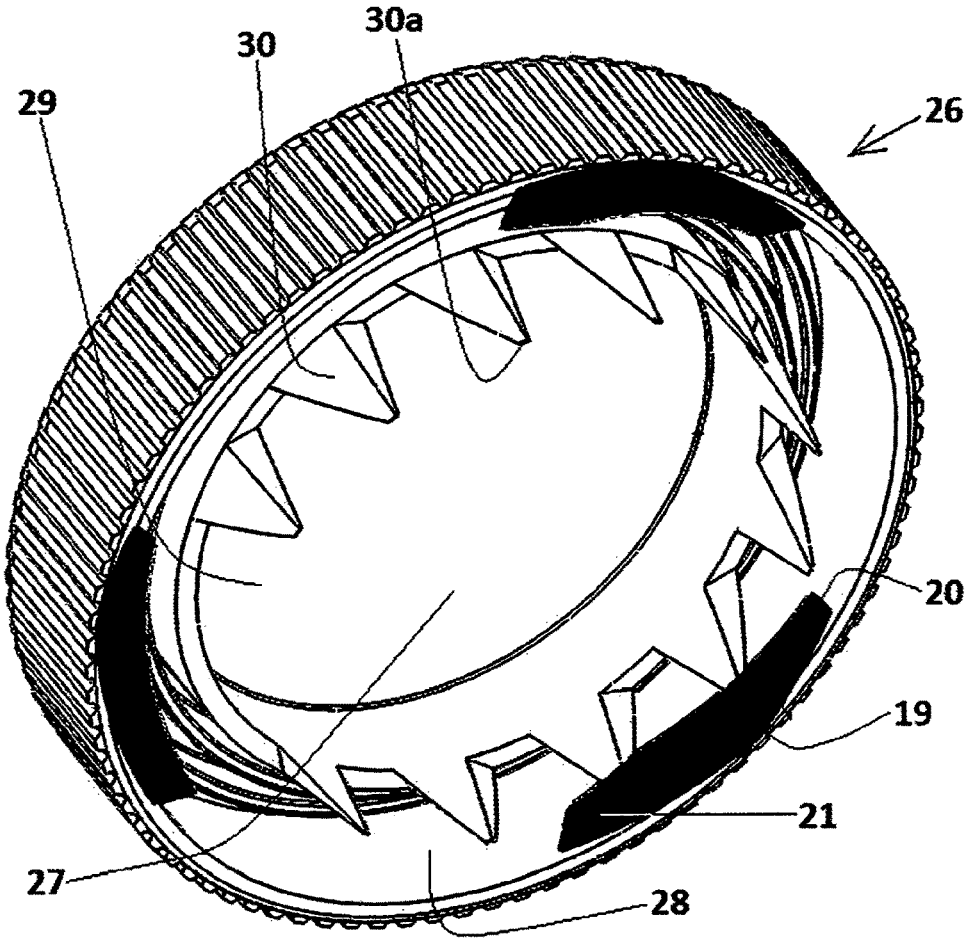
FIG. 2 is a bottom perspective view of a cap provided with inner thread segments forming part of the automatic opening device for carton packages of the present invention.

The cap 26, shown in FIG. 2, basically comprises a disc-shaped cap element 27 having an inner face 29 and an elongate side wall 28 in the shape of a straight cylinder trunk. Inner thread segments 19 are provided inside the elongated side wall 28. In the present case three segments are provided equidistant from each other and also equidistant of the inner face 29 of the disc-shaped cap element 27.

The inner thread segments 19 are provided with a front end 20, and a rear end 21.

In the present embodiment the inner thread segments 19 are, in fact, segments of an internal six-entries thread, which has the same characteristics as the thread 2 applied to the spout 3, wherein only three inner thread segments 19 were manufactured instead the six inner thread segments 19 that could have been manufactured. In other words, segments were manufactured in an alternate manner.

It should be mentioned that the provision in the present embodiment of only three inner thread segments 19 is only a design option, and can in no way be considered a limitation of the invention. There would be no impediment for the cap 26 to be provided with all possible inner thread segments 19. In the case of the present embodiment there would be six inner thread segments 19.

As can be seen in FIG. 2, the inner face 29 of the top element 27 is provided with multiple protruding cutting elements 30, distributed circumferentially and provided with sharp ends 30*a*, which in this embodiment form a rotating cutting element, intended to cut the package, as will be seen in the following.

Figure 3:
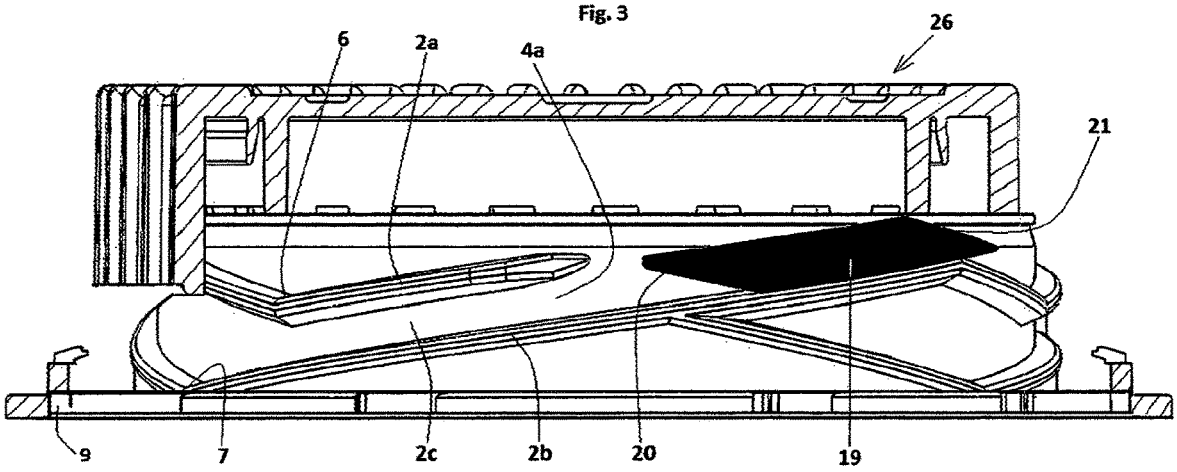
FIG. 3 is a front cross-sectional view showing the time when the inner thread segments of the cap begin to be inserted into the inner thread of the spout.

When the cap 26 is screwed on the thread 2 of the spout 3 for the first time, a factory-made operation, the front ends 20 of the inner thread segments 19 will pass through the entries 4*a* of the thread 2, and will engage the downward grooves 2*c*, as can be seen in FIG. 3.

As the inner thread segments 19 are screwed onto the outer thread 2, they will effect a concomitant downward axial movement, and consequently, the same will occur with the cap 26. In other words, in addition to the rotational twisting movement, there will also occur a downward axial movement.

Figure 4:
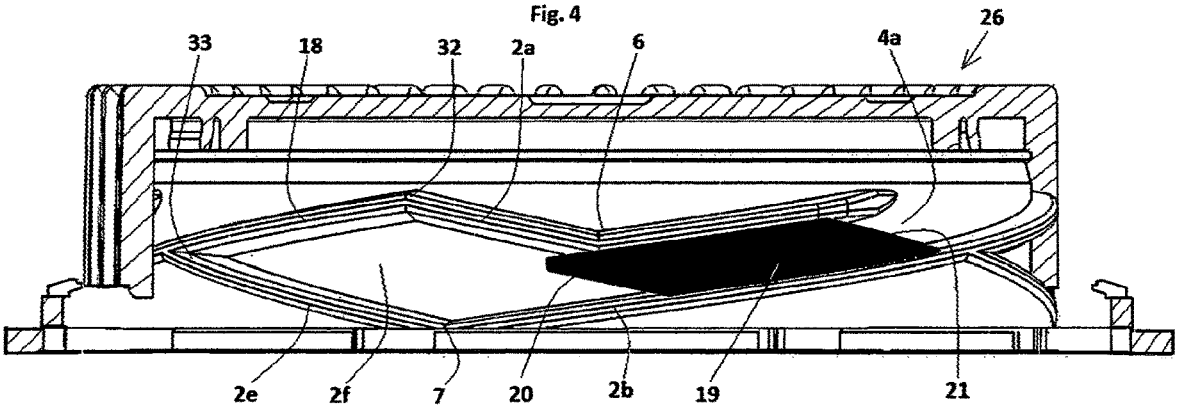
FIG. 4 is a front cross-sectional view showing the moment when the inner threads of the cap are in a first position, partially inserted in the grooves of the inner thread of the spout.

With the continuity of the rotational screwing movement of the inner thread segments 19 on the grooves 2*c* of the thread 2 of the spout 3, the front ends 20 of the internal thread segments 19 will advance along the inside of the downward grooves 2*c*, as shown in FIG. 4.

Figure 5:
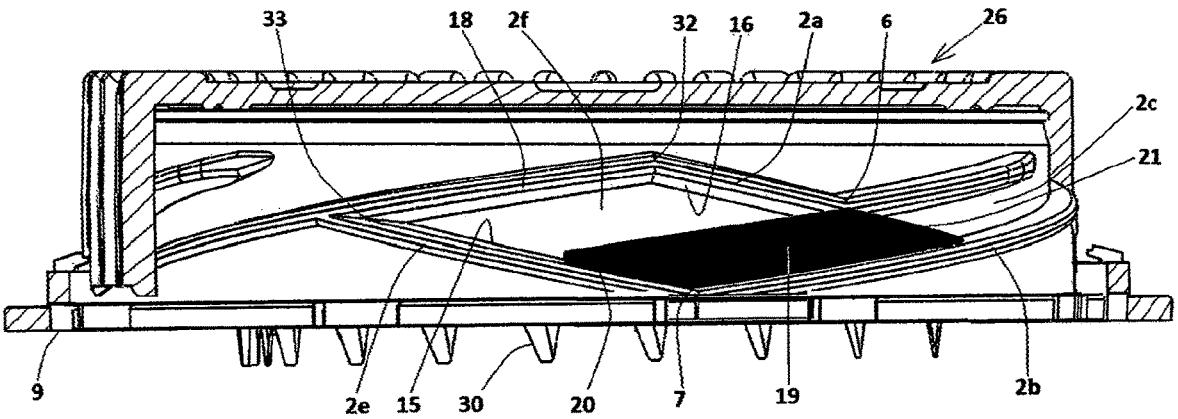
FIG. 5 is a front cross-sectional view showing the moment when the inner threads of the cap are in a second position, partially inserted in the grooves of the inner thread of the spout.
Figure 6:
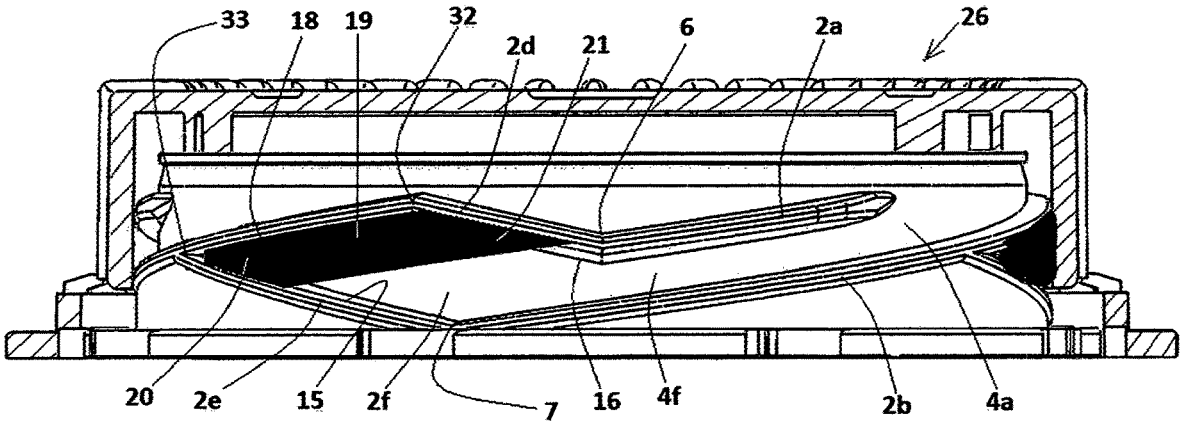
FIG. 6 is a front cross-sectional view showing the moment when the inner threads of the cap are fully inserted into the grooves of the inner thread of the spout in their final mounting position.

At a determined moment, the rear ends 21 of each inner thread segment 19 will pass by the first junction point 6 and the front ends 20 of the inner thread segments 19 will reach the second junction point 7 at the lower end of the first downward lower thread 2*b*, as shown in FIG. 5.

Thereafter, the inner thread segments 19 will leave the downward groove 2*c* and will be directed to the upward groove 2*f*, and the front ends 20 of the inner thread segments 19 will be forced against the upper flanks 15 of the second upward lower threads 2*e*.

Upon continuation of the screwing movement, the front ends 20 of the inner thread segments 19 will slide through the upper flanks 15 of the second upward lower threads 2*e*.

As the second upward lower threads 2*e* have a left-handed upward thread configuration, this will cause the inner thread segments 19 to undergo a reversal of direction in their axial movement, which will then be an upward axial movement, as the inner thread segments 19 traverse the extension of the upper flanks 15 of the second lower upward threads 2*e*, within the upward groove 2*f*.

Consequently, the cap 26 will start making a linear upward movement, which ends at the instant the entry ends 20 of the inner thread segments 19 reach the lower flank 18*i* of the end-stops 18.

At this instant, the closure movement of the cap 26 on the spout 3 then ends.

It is important to mention that the inner thread segments 19 are designed in such a way as to perfectly fit within the upward grooves 2*f*, so that no problems occur during the closing operation of the cap 26, and in particular at the moment the inner thread segments 19 undergo a change of direction in their axial movement to start their entry into the upward grooves 2*f*.

When it is necessary to remove the cap 26 from its engagement to the spout 3 for the first time, a rotational movement of unscrewing of the cap 26 relative to the outer thread 2 of the spout 3 should be effected.

At the start of this unscrewing movement, the rear ends 21 of the inner thread segments 19 will touch the lower flanks 16 of the second upward threads 2*d*, which will cause the inner thread segments 19 to start a downward axial movement, in addition to effecting an unscrewing rotating movement, to also start a downward axial movement as a result of the second upper threads 2*d* having a left-handed upward thread configuration.

Concomitantly, the front ends 20 of the inner thread segments 19 will run through the upper flanks 15 of the second lower threads 2*e* as the unscrewing movement of the cap 26 is effected.

This downward axial movement of the inner thread segments 19 ends when the rear ends 21 of the inner thread segments 19 fully passes by the first junction point 6 and the front ends 20 of the inner thread segments 19 reach the second junction point 7.

At this moment the inner thread segments 19 will start their entry into the lower regions of the downward grooves 2*c* defined between the first downward upper threads 2*a* and the first downward lower threads 2*b*.

From this moment on, and with the continued continuity of the unscrewing movement of the cap 26, the inner thread segments 19 will travel the first downward grooves 2*c* towards the entries 4*a*. After the inner thread segments 19 have passed entirely through the entries 4*a* the cap 26 is then completely unscrewed from the spout 3.

The combination of the initial circular unscrewing movement of the cap 26 and the consequent downward axial movement described above will cause the sharp ends 30*a* of the protruding cutting elements 30 to project onto the package from their initial mounting position, thereby opening the package on which the cap 26 is mounted.

The magnitude of the downward axial movement of the cap 26 will be dependent on the angles of inclination of the second upward upper thread 2*d* and the second upward lower thread 2*e* with respect to their generatrixes, which are substantially the same.

Although the rotating cutting element shown in FIG. 2 has protruding cutting elements 30 nearly the entire perimeter thereof, to ensure that the package is cut by their sharp ends 30*a* when the cap is open, a lesser number of protruding cutting elements 30 may be provided to save material, as long as they are provided in sufficient number to ensure the cutting of the package during the initial downward unscrewing of the cap.

For reasons of safety and hygiene, the cap 26 may be provided with an unscrewing prevention mechanism, not shown in the Figures. One of the functions of these cap screw unscrewing mechanisms is to provide the end user with a guarantee that the cap 26 has remained in the position in which it was assembled at the factory until the time when it will be unscrewed for removal of the content from the package.

It is known in the art various types of tamper evident device to prevent unauthorised unscrewing of the cap, which, for this reason, are not described herein. In addition, they are not part of the present invention, and there is no impediment to them being used in conjunction therewith.

Thus, as has been shown, the automatic opening device 1 object of the present invention provides an effective means of simple manufacture and use by providing components which cause a change in the direction of axial movement of the cap 26 at the initial moment when it is unscrewed from the spout 3.

Further, the present invention obviates the use of additional components, requires less material and less manufacturing time, and simplifies the entire assembly operation in the factory thereby reducing manufacturing costs and offers significant economic advantages.

While the present invention has been described with its application in threaded package spouts and applied to mechanisms driven by the unscrewing movement of caps or closures coupled to these spouts, it should be mentioned that the automatic opening device of the present invention may be employed in any case in which it is necessary to use a cap provided with a rotating cutting element which serves to cut the material located immediately below the cap when the cap starts to be unscrewed from the spout to which it is engaged.

Thus, the present invention is not limited to the applications described in this specification and is only limited to the content of the claims that follow.

The invention claimed is:

1. An automatic opening device (1) for packages, said automatic opening device (1) comprising:

an elongated cylindrical body (3);

a cap (26);

a base element (9) provided with an upper face (9*s*) and a lower face (9*i*), the outer surface of the elongated cylindrical body (3) being provided with a thread (2), the lower face (9*i*) of the base element (9) being able to be affixed to a pierceable portion of a package;

wherein the cap (26) comprises a disc-like cap element (27) provided with an inner face (29) and an elongate side wall (28) extending vertically, a thread being provided onto the inner surface of the elongate side wall (28) allowing the cap (26) to screw onto the external thread (2) of the elongated cylindrical body (3);

wherein the thread (2) comprises at least one first groove (2*c*) and at least one second groove (2*f*) of opposite orientation with respect to said at least one first groove (2*c*), said at least one second groove (2*f*) being a continuation of said at least one first groove (2*c*); and wherein the cap (26) is provided with a cutting means to cut said pierceable portion of the package.

2. The automatic opening device according to claim 1, wherein:

each of said at least one first groove (2*c*) is formed between a first upper thread (2*a*), provided with an upper flank (10) and a lower flank (12), and a first lower thread (2*b*) provided with an upper flank (11) and a lower flank (13);

an inlet (4*a*) is provided in each of said at least one first groove (2*c*);

each of said at least one second groove (2*f*) is formed between a second upper thread (2*d*), provided with an upper flank (14) and a lower flank (16), and a second lower thread (2*e*), provided with an upper flank (15) and a lower flank (17), the second upper thread (2*d*) being a continuation of the first upper thread (2*a*) and the second lower thread (2*e*) being a continuation of to the first lower thread (2*b*);

an end-stop (18) is provided at an end portion of each of said second groove (2*f*), the end-stop being provided with a lower flank (18*a*);

the inner end of said lower flank (12) of the first upper thread (2*a*) connects to a first end of said lower flank (16) of the second upper thread (2*d*) at a first junction point (6), forming a lower concave angle between them, a transition occurring from a right-handed thread configuration of the first upper thread (2*a*) to a left-handed thread configuration of the second upper thread (2*d*);

the inner end of said upper flank (11) of the first lower thread (2*b*) connects to a first end of said upper flank (15) of the second lower thread (2*e*) at a second junction point (7), forming an upper convex angle between them, a transition occurring from a right-handed thread configuration of the first lower thread (2*b*) to a left-handed thread configuration for the second lower thread (2*e*);

a first end of said lower flank (18*a*) of the end-stop (18) connects to a second opposite end of said lower flank (16) of the second upper thread (2*d*) at a third junction point (33), forming an upper convex angle between them;

a second opposite end of said lower flank (18*a*) of the end-stop (18) connects to a second opposite end of said upper flank (15) of the second lower thread (2*e*) at a fourth junction point (33), forming a lower convex angle between them.

3. The automatic opening device according to claim 2, in that said cap (26) is provided with a thread onto the inner surface of the elongate side wall (28) of the cap (26) comprising a plurality of segments of internal thread (19) designed to engage said external thread (2).

4. The automatic opening device according to claim 3, in that the cap (26) is provided with at least one protruding cutting element (30), extending from the inner face (29) of the top element (27).

5. The automatic opening device according to claim 4, in that said at least one protruding cutting member (30) is provided with a sharp end (30*a*).

6. The automatic opening device according to claim 5, in that said at least one protruding cutting element (30) comprises a plurality of protruding cutting elements distributed circularly onto the inner face (29) of the top member (27) of the cap (26).

7. The automatic opening device according to claim 6, in that said first groove (2*c*) comprises a right-hand thread and said second groove (2*f*) comprises a left-hand thread.

8. The automatic opening device according to claim 2, in that said cutting means comprises at least one protruding cutting element (30).

9. The automatic opening device according to claim 8, in that said at least one protruding cutting element (30) comprises a plurality of protruding cutting elements distributed circularly onto the inner face (29) of the top member (27) of the cap (26).

10. The automatic opening device according to claim 9, in that said first groove (2*c*) comprises a right-hand thread and said second groove (2*f*) comprises a left-hand thread.

11. A thread (2) of variable orientation for use in packages comprising a first groove (2*c*) followed by a second groove (2*f*) of opposite orientation wherein the thread (2) comprises:

the first groove (2*c*) is formed between a first upper thread (2*a*), provided with an upper flank (10) and a lower flank (12), and a first lower thread (2*b*) provided with an upper flank (11) and a lower flank (13);

an inlet (4*a*) is provided in the first groove (2*c*);

the second groove (2*f*) is formed between a second upper thread (2*d*), provided with an upper flank (14) and a lower flank (16), and a second lower thread (2*e*), provided with an upper flank (15) and a lower flank (17), the second upper thread (2*d*) being a continuation of the first upper thread (2*a*) and the second lower thread (2*e*) being a continuation of to the first lower thread (2*b*);

the inner end of said lower flank (12) of the first upper thread (2*a*) connects to a first end of said lower flank (16) of the second upper thread (2*d*) at a first junction point (6), forming a lower concave angle between them, a transition occurring from a right-handed thread configuration of the first upper thread (2*a*) to a left-handed thread configuration of the second upper thread (2*d*);

the inner end of said upper flank (11) of the first lower thread (2*b*) connects to a first end of said upper flank (15) of the second lower thread (2*e*) at a second junction point (7), forming an upper convex angle between them, a transition occurring from a right-handed thread configuration of the first lower thread (2*b*) to a left-handed thread configuration for the second lower thread (2*e*);

a first end of said lower flank (18*a*) of the end-stop (18) connects to a second opposite end of said lower flank (16) of the second upper thread (2*d*) at a third junction point (32), forming an upper convex angle between them;

a second opposite end of said lower flank (18*a*) of the end-stop (18) connects to a second opposite end of said upper flank (15) of the second lower thread (2*e*) at a fourth junction point (33), forming a lower convex angle between them.

12. A thread (2) according to claim 11, in that said first groove (2*c*) comprises a right-hand thread and said second groove (2*f*) comprises a left-hand thread.

* * * * *